US005855122A

United States Patent [19]

Lonati et al.

[11] Patent Number: 5,855,122

[45] Date of Patent: Jan. 5, 1999

[54] HOOK FOR SINGLE-CYLINDER CIRCULAR KNITTING OR STOCKING MACHINES WITH CYLINDER AND CIRCULAR OR SEMICIRCULAR PLATE

[75] Inventors: Francesco Lonati; Ettore Lonati; Fausto Lonati; Tiberio Lonati, all of Brescia, Italy

[73] Assignee: Lonati S.p.A., Monza, Italy

[21] Appl. No.: 871,377

[22] Filed: Jun. 9, 1997

[30] Foreign Application Priority Data

Jun. 21, 1996 [IT] Italy ..... MI96A1272

[51] Int. Cl.[6] ..... D04B 15/02

[52] U.S. Cl. ..... 66/95

[58] Field of Search ..... 66/64, 95, 107, 66/147

[56] References Cited

U.S. PATENT DOCUMENTS

| | | | |
|---|---|---|---|
| 1,869,147 | 7/1932 | Hill | 66/95 X |
| 2,040,319 | 5/1936 | Lombardi | 66/95 X |
| 2,175,297 | 10/1939 | Lawson | 66/24 |
| 2,622,421 | 12/1952 | Minton | 66/95 X |
| 2,626,515 | 1/1953 | St Pierre | 66/95 |
| 2,809,508 | 10/1957 | McDounough | 66/95 |
| 3,609,998 | 10/1971 | Mutze et al. | 66/95 |
| 3,783,644 | 1/1974 | Mutze et al. | 66/95 |
| 4,005,589 | 2/1977 | Uhlir | 66/95 |

FOREIGN PATENT DOCUMENTS

| | | | |
|---|---|---|---|
| 1906132 | 7/1970 | Germany | 66/95 |

*Primary Examiner*—John J. Calvert
*Attorney, Agent, or Firm*—Guido Modiano; Albert Josif

[57] ABSTRACT

A hook for single-cylinder circular knitting or stocking machines with cylinder and circular or semicircular plate. The hook comprises an elongated and flat hook body which has a claw-shaped longitudinal tip. The hook also comprises an elastic-lamina element which is associated with a lateral face of the hook body and has a claw-shaped tip which faces the claw-shaped tip of the hook body. A passage is formed between the lamina element and the hook body and is suitable to be crossed by a needle of the knitting or stocking machine; the claw-shaped tip of the lamina element can flex elastically towards and away from the hook body, respectively to close the claw-shaped tip of the hook body and to allow the extraction of the needle inserted in the passage towards the claw-shaped tip of the hook body.

11 Claims, 4 Drawing Sheets

HOOK FOR SINGLE-CYLINDER CIRCULAR KNITTING OR STOCKING MACHINES WITH CYLINDER AND CIRCULAR OR SEMICIRCULAR PLATE

BACKGROUND OF THE INVENTION

The present invention relates to a hook for single-cylinder circular knitting or stocking machines with cylinder and circular or semicircular plate.

Conventional single-cylinder circular knitting or stocking machines can close a longitudinal end of the tubular knitted item during its manufacture.

These machines are generally provided with a semicircular plate which is arranged above the needle cylinder of the machine and can be overturned, substantially through a 180° angle, about a diametrical axis of the needle cylinder in order to face one half or the other of the needle cylinder.

Inside the semicircular plate there is a plurality of double radial grooves, and inside each double groove there are two or more hooks whose claw-shaped tips are mutually opposite. The hooks of each double groove can be actuated individually in order to engage the loops formed by the needles of one half of the needle cylinder and to retain them inside the claw-shaped tips during the overturning of the semicircular plate about the diametrical axis. After overturning, the hooks are actuated again so as to release the previously retained loops, which are engaged by the needles of the other half of the needle cylinder.

Through the transfer of the formed loops from one half of the needle cylinder to the needles of the other half of the needle cylinder, an axial end of the tubular item manufactured by the circular knitting or stocking machine is closed.

In order to engage and retain the loops of knitting during the overturning of the semicircular plate, it is necessary to use, for each one of the double grooves of the semicircular plate, at least one pair of hooks in which the tip directed towards the outside of the semicircular plate is claw-shaped and in which the claw-shaped tips of the two hooks are mutually opposite so that by means of the coordinated actuation of the two hooks along the corresponding double groove it is possible to open or close the claw-shaped tip of a hook by means of the claw-shaped tip of the other hook that is arranged adjacent thereto.

As a consequence of this fact, it is necessary to provide a plurality of double grooves inside the semicircular plate in order to accommodate and guide the two hooks.

Other machines use, in order to manufacture items with a closed axial end, a circular plate which is divided into two halves, a first one of which can be overturned below the other circular plate half in order to transfer the loops from the needles of one half of the needle cylinder to the needles of the other half of the cylinder.

In any case, the fact of having to provide two hooks for each loop of knitting to be transferred is a complication of the structure of the machine, also in view of the fact that the hooks of the various pairs must be actuated independently of each other in order to engage or release the knitting loops.

SUMMARY OF THE INVENTION

A principal aim of the present invention is to solve the above-described problem by providing a hook which can be used in single-cylinder circular knitting or stocking machines with a cylinder and a circular or semicircular plate, particularly in machines for manufacturing tubular items closed at an axial end, and is structurally simple and reliable in operation.

Within the scope of this aim, an object of the present invention is to provide a hook which can be used, in combination with a semicircular plate which can be overturned about a diametrical axis of the needle cylinder of circular knitting or stocking machines, in order to transfer the loops from the needles of one half of the needle cylinder to the needles of the other half of the needle cylinder.

Another object of the present invention is to provide a hook which considerably simplifies the execution of the semicircular plate and of the cams for actuating the various hooks.

This aim, these objects, and others which will become apparent hereinafter are achieved by a hook for single-cylinder circular knitting or stocking machines with cylinder and circular or semicircular plate, comprising an elongated and flat hook body which has a claw-shaped longitudinal tip, characterized in that it comprises an elastic-lamina element which is associated with a lateral face of the hook body and has a claw-shaped tip which faces the claw-shaped tip of the hook body, a passage being formed between said lamina element and said hook body and being suitable to be crossed by a needle of the knitting or stocking machine, said claw-shaped tip of the lamina element being elastically flexible towards or away from the hook body, respectively to close the claw-shaped tip of the hook body and to allow the extraction of the needle inserted in said passage towards the claw-shaped tip of the hook body.

BRIEF DESCRIPTION OF THE DRAWINGS

Further characteristics and advantages of the present invention will become apparent from the following detailed description of a preferred but not exclusive embodiment of the hook according to the invention, illustrated only by way of non-limitative example in the accompanying drawings, wherein.

DESCRIPTION OF THE PREFERRED EMBODIMENTS

Figure 2:
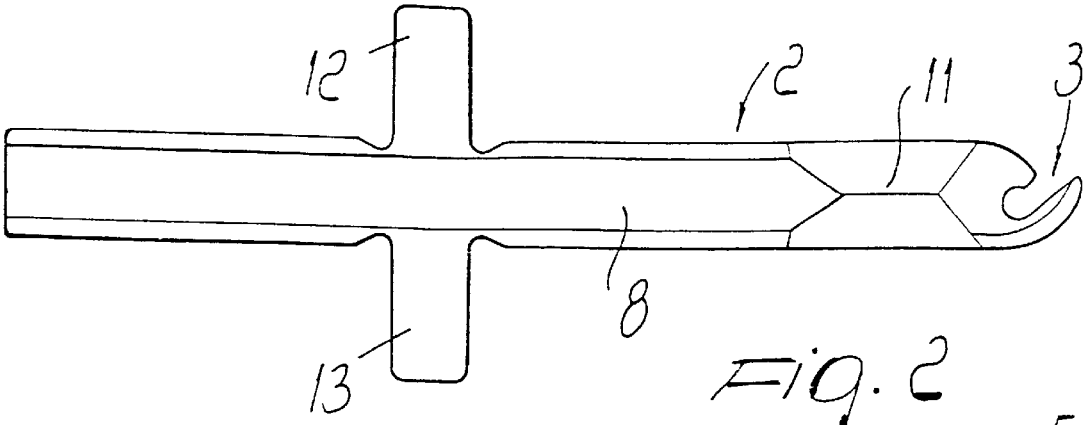
FIG. 2 is a lateral elevation view of the hook body according to the invention.
Figure 3:
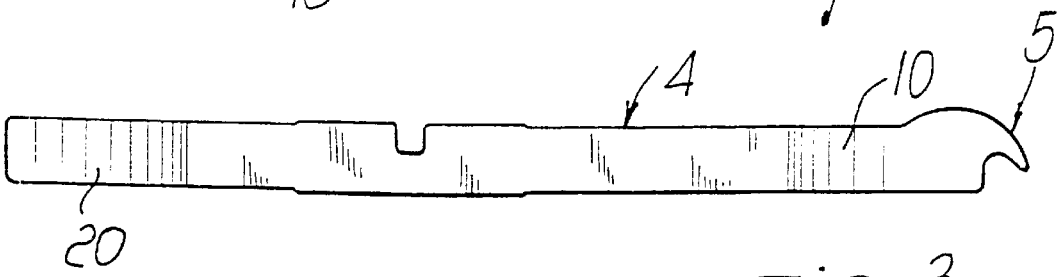
FIG. 3 is a lateral elevation view of the lamina element of the hook according to the invention.
Figure 1:
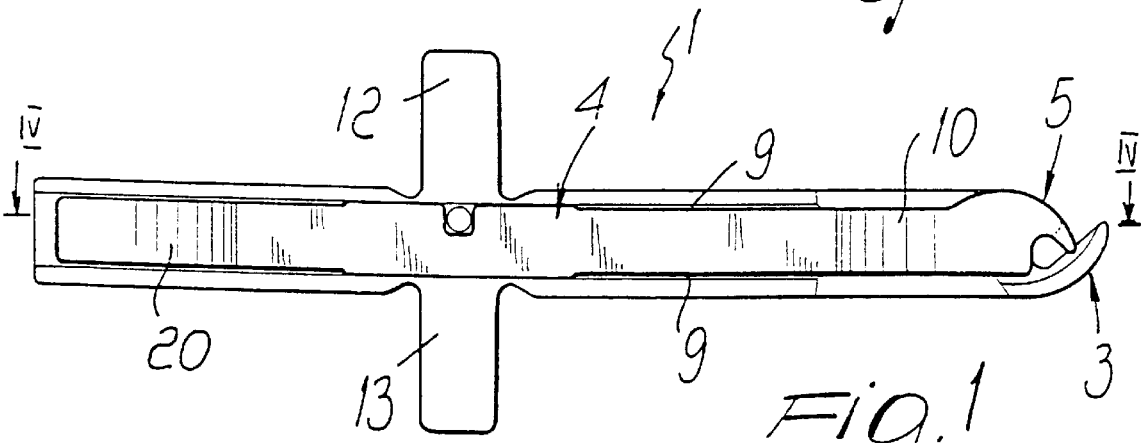
FIG. 1 is a lateral elevation view of the hook according to the present invention.
Figure 4:
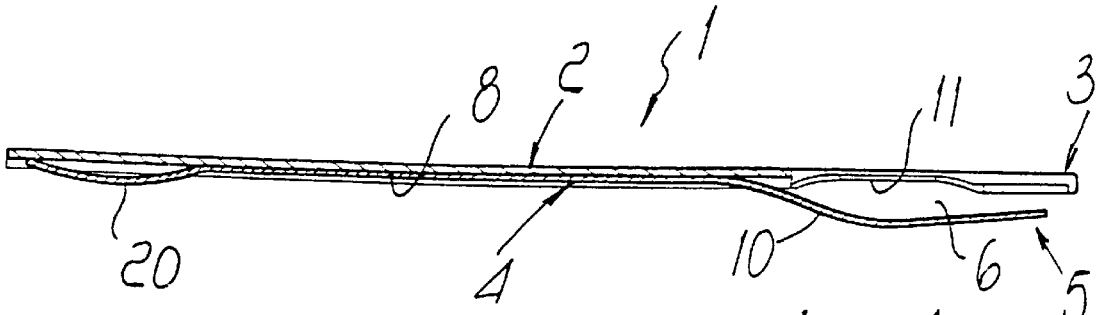
FIG. 4 is a sectional view of FIG. 1, taken along the plane IV—IV.

With reference to the above figures, the hook according to the invention, generally designated by the reference numeral 1, comprises an elongated and flat hook body 2 which has a claw-shaped longitudinal tip 3.

According to the invention, the hook 1 also comprises an elastic-lamina element 4, which is associated with a lateral face of the hook body 2 and has a tip 5 which is also claw-shaped and faces the claw-shaped tip 3 of the hook body 2.

Between the lamina element 4 and the hook body 2 there is a passage 6 which can be crossed by a needle 7 of the knitting or stocking machine.

The claw-shaped end 5 of the lamina element 4 can also flex elastically towards or away from the hook body 2, respectively to close the claw-shaped tip 3 of the hook body 2 and to allow the extraction of the needle 7, inserted beforehand through the passage 6, towards the claw-shaped tip 3 of the hook body 2.

More particularly, a recess 8 is formed in a lateral face of the hook body 2 and accommodates a portion of the longitudinal extension of the lamina element 4, which is spaced with respect to its claw-shaped tip 5.

The lamina element 4 is fixed laterally with respect to the hook body 2, for example by means of riveted portions 9 at the longitudinal edges of the recess 8.

The claw-shaped tip 5 of the lamina element 4 is connected to the portion of the lamina element 4 that is inserted in the recess 8, by means of a portion 10 which is inclined with respect to the plane of arrangement of the hook body 2. Conveniently, the hook body 2 has a recessed portion 11 on its lateral face which is directed towards the lamina element 4 at the passage 6.

The claw-shaped tip 5 of the lamina element 4, in the inactive condition, is spaced laterally from the hook body 2, so as to allow, in this position, the insertion of a thread 21 in the hollow of the claw-shaped tip 3.

The claw-shaped tip 3 of the hook body 2 protrudes outwards, in the direction of the longitudinal extension of the hook body 2, with respect to the claw-shaped tip 5 of the lamina element 4.

The hook body 2 is provided with at least one actuation heel, preferably two heels 12 and 13 which protrude upwards and downwards, respectively, from the hook body 2 transversely to its longitudinal extension.

Advantageously, the hook according to the present invention, in the inactive condition, has an overall thickness, measured transversely to the plane of arrangement of the hook body 2 in the region where the lamina element 4 is spaced furthest from the hook body 2, which is greater than the width of the groove 14 of the circular or semicircular plate 15 of the circular knitting or stocking machine in which it is to be inserted. As a consequence of this fact, through a partial retraction of the hook inside the corresponding groove 14 the interference of one side of the groove 14 against the inclined portion 10 is achieved, and therefore the approach of the claw-shaped tip 5 of the lamina element 4 to the claw-shaped tip 3 of the hook body 2 and, as a consequence of a partial extraction of the hook from the corresponding groove, in a radial direction, by means of the elasticity of the lamina element 4, the spacing of the claw-shaped tip 5 of the lamina element 4 from the claw-shaped tip 3 of the hook body 2 is obtained in a lateral direction.

The hook according to the invention can be actuated, by using the heels 12 and 13, with a reciprocating motion along the corresponding groove 14, in a per se known manner, through actuation cams 16 which face the circular or semicircular plate 15 from above or below.

For the sake of completeness in description, it should be noted that the longitudinal tip of the lamina element 4 which lies opposite to the claw-shaped tip 5 has a curve 20 directed away from the hook body 2. Said curve 20 has the purpose of producing friction against the side of the groove 14 of the semicircular plate 15 in order to prevent accidental sliding of the hook along the groove 14.

Figure 11:
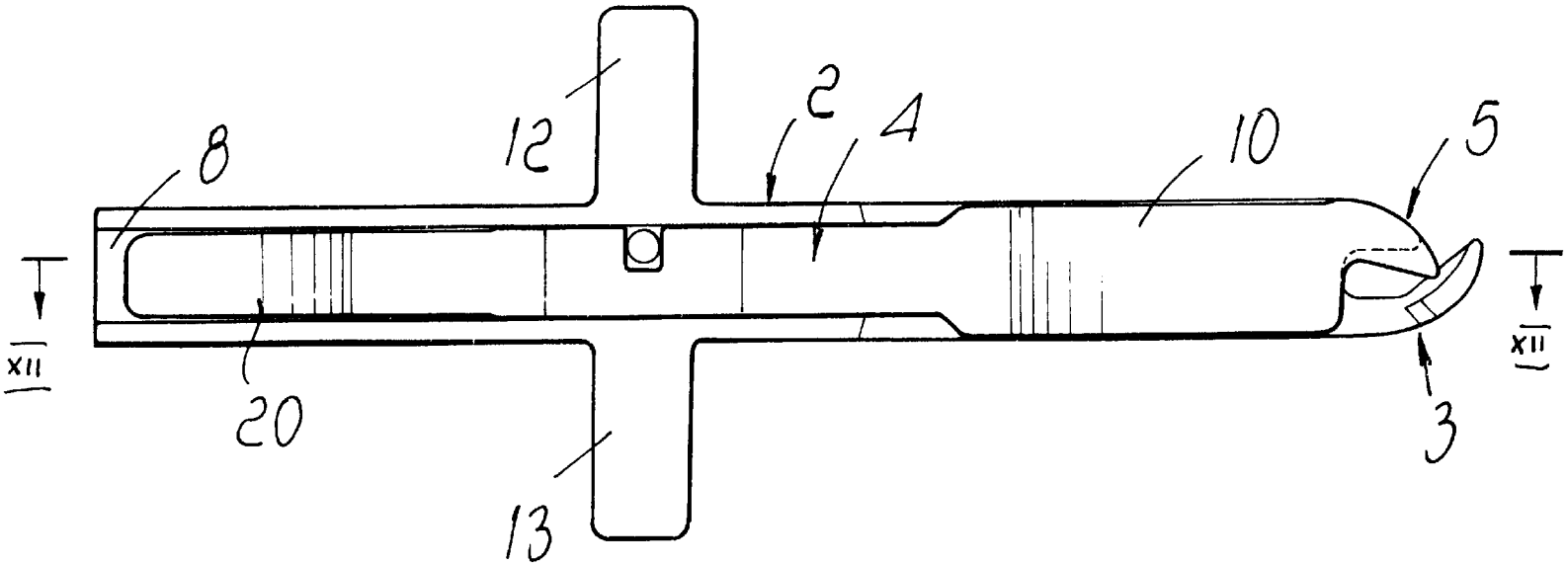
FIG. 11 is a lateral elevation view of a different embodiment of the hook according to the present invention.
Figure 12:
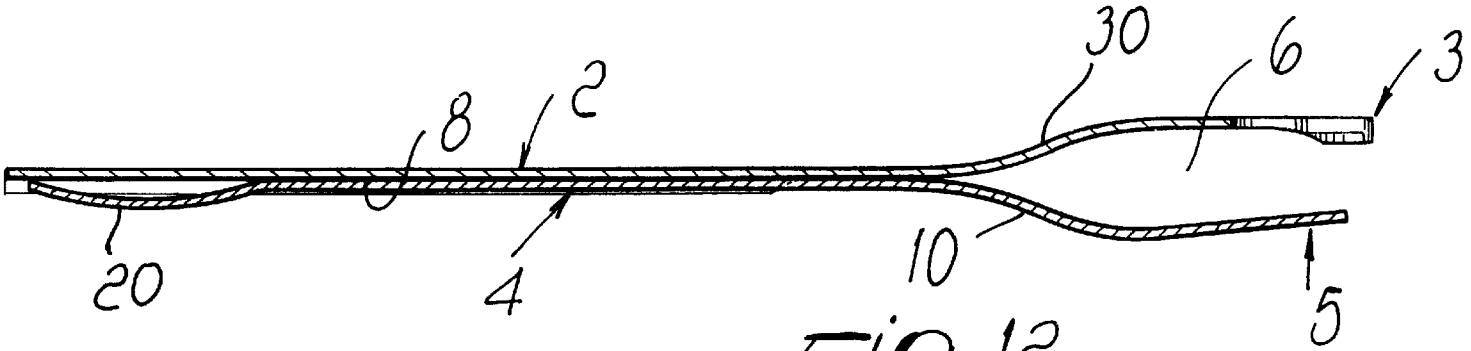
FIG. 12 is a sectional view of FIG. 11, taken along the plane XII—XII.

In the different embodiment shown in FIGS. 11 and 12, for which the same reference numerals as in the previous figures have been retained, the hook body 2 has, proximate to its claw-shaped tip, a bend 30 directed away from the lamina element 4 in order to increase the width of the passage 6. In this different embodiment, the recessed portion 11 may be omitted, in that the face of the hook body 2 that is directed towards the lamina element 4 is substantially flat. Furthermore, in this embodiment, at least the portion of the hook body 2 that lies between the bend 30 and the claw-shaped tip 3 is elastically flexible towards or away from the lamina element 4.

Operation of the hook in transferring the loops from the needles of one half of the needle cylinder to the needles of the other half of the needle cylinder is as follows.

Figure 5:
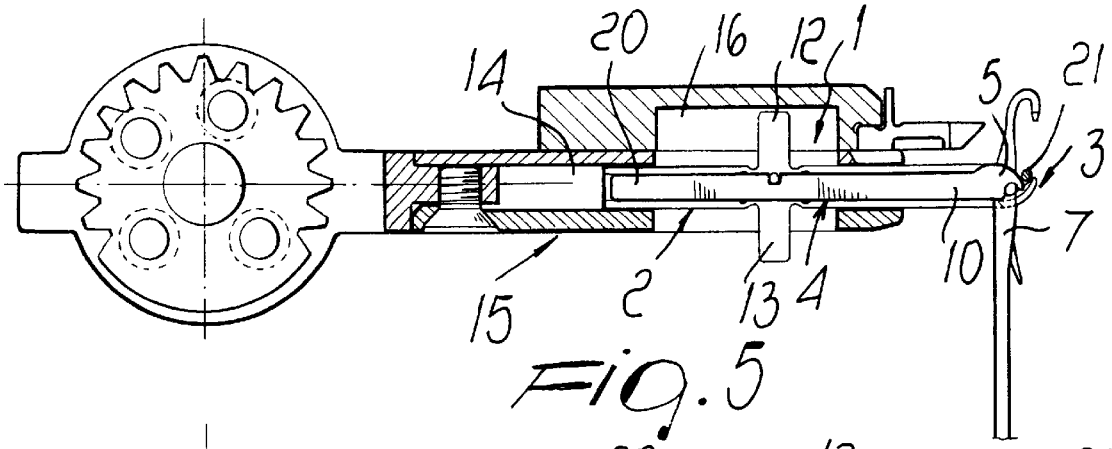
FIGS. 5 to 8 are views of the sequence for the transfer of the loops of knitting from the needles of one half of the needle cylinder to the needles of the other half of the needle cylinder by means of hooks according to the invention, fitted on an overturning semicircular plate.

As shown in FIG. 5, during the feeding of the thread 21 to form loops of knitting, the hooks according to the invention are partially extracted from the corresponding grooves 14 of the circular or semicircular plate 15, so that the thread fed to the needles 7 deposits on the claw-shaped tip 3 of the hook body 2, which as mentioned protrudes outwards with respect to the claw-shaped tip 5 of the corresponding lamina element 4.

Figure 6:
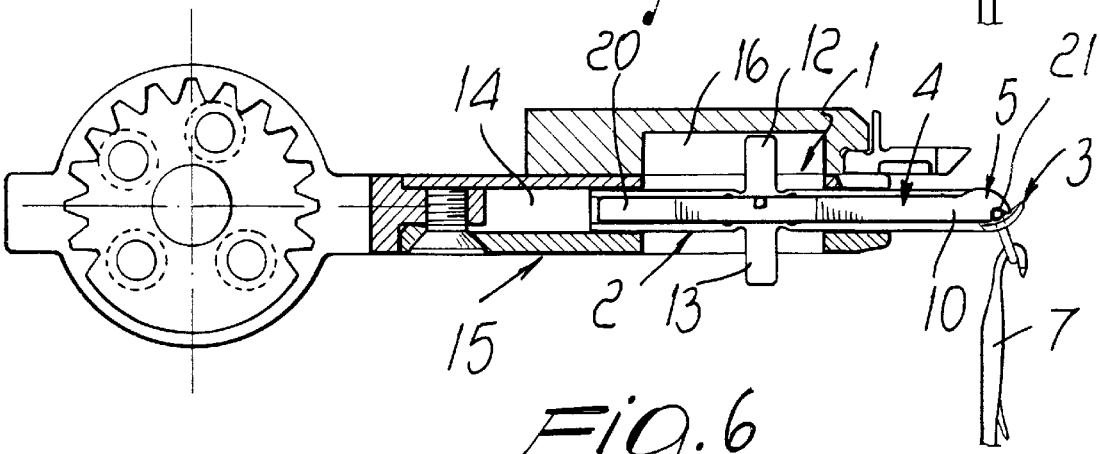

The descent of the needle 7 proximate to the hook 1 causes the passage of the thread 21 along the bottom of the concave portion of the claw-shaped tip 3 below the claw-shaped tip 5 of the lamina element 4 (FIG. 6).

It should be noted that when the hook is partially extracted from the corresponding groove 14, the claw-shaped tip 5 of the lamina element 4 is spaced laterally with respect to the claw-shaped tip 3 of the hook body 2 and therefore allows the passage of the thread 21 along the bottom of the concave portion of the claw-shaped tip 3.

Figure 7:
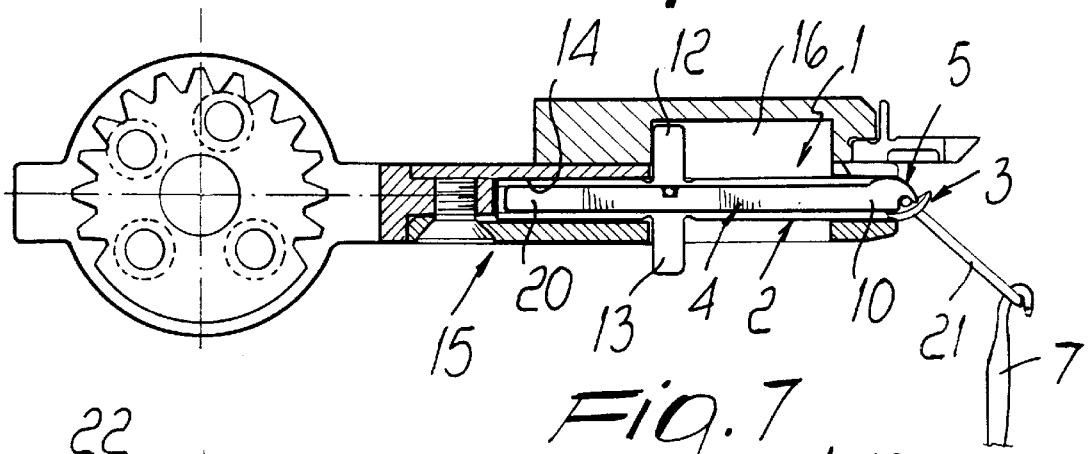

The hook 1 is then retracted into the corresponding groove 14 of the circular or semicircular plate 15, and as a consequence of this retraction the inclined portion 10, and optionally the bend 30, interferes against one side of the corresponding groove 14, causing the claw-shaped tip 5 of the lamina element 4 to move towards and against the claw-shaped tip 3 of the hook body 2. As a consequence of this fact, the loop of knitting stretched between the needle 7 and the hook 1 is retained between the two claw-shaped tips 3 and 5. In this condition a portion of knitting can be knit or the needle 7 can be raised and then lowered to release the loop, depending on the method for closing the tip of the tubular item to be used (FIG. 7).

The semicircular plate 15 is then overturned about the diametrical axis 22 and made to face the needles of the other half of the needle cylinder.

During overturning, the loops of knitting are firmly retained between the claw-shaped tips 3 and 5, which are in mutual contact and therefore safely prevent any extraction.

Figure 8:
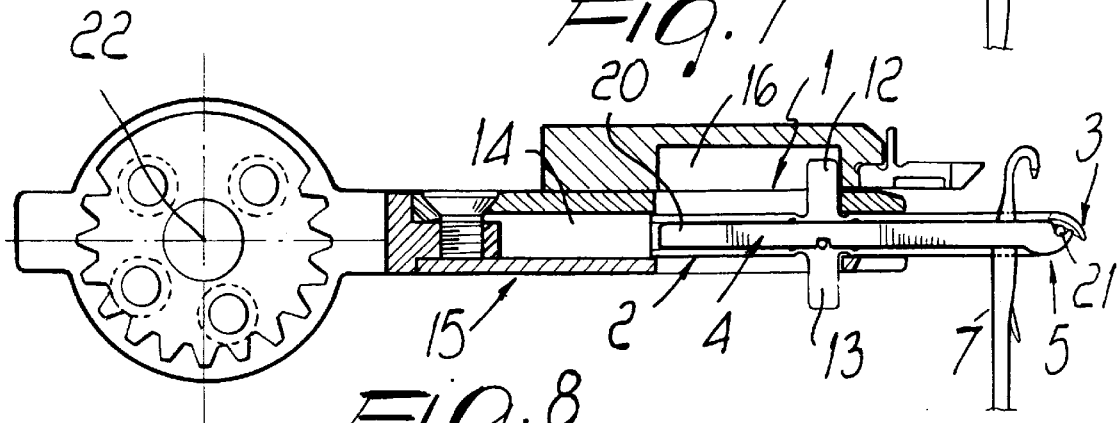
Figure 9:
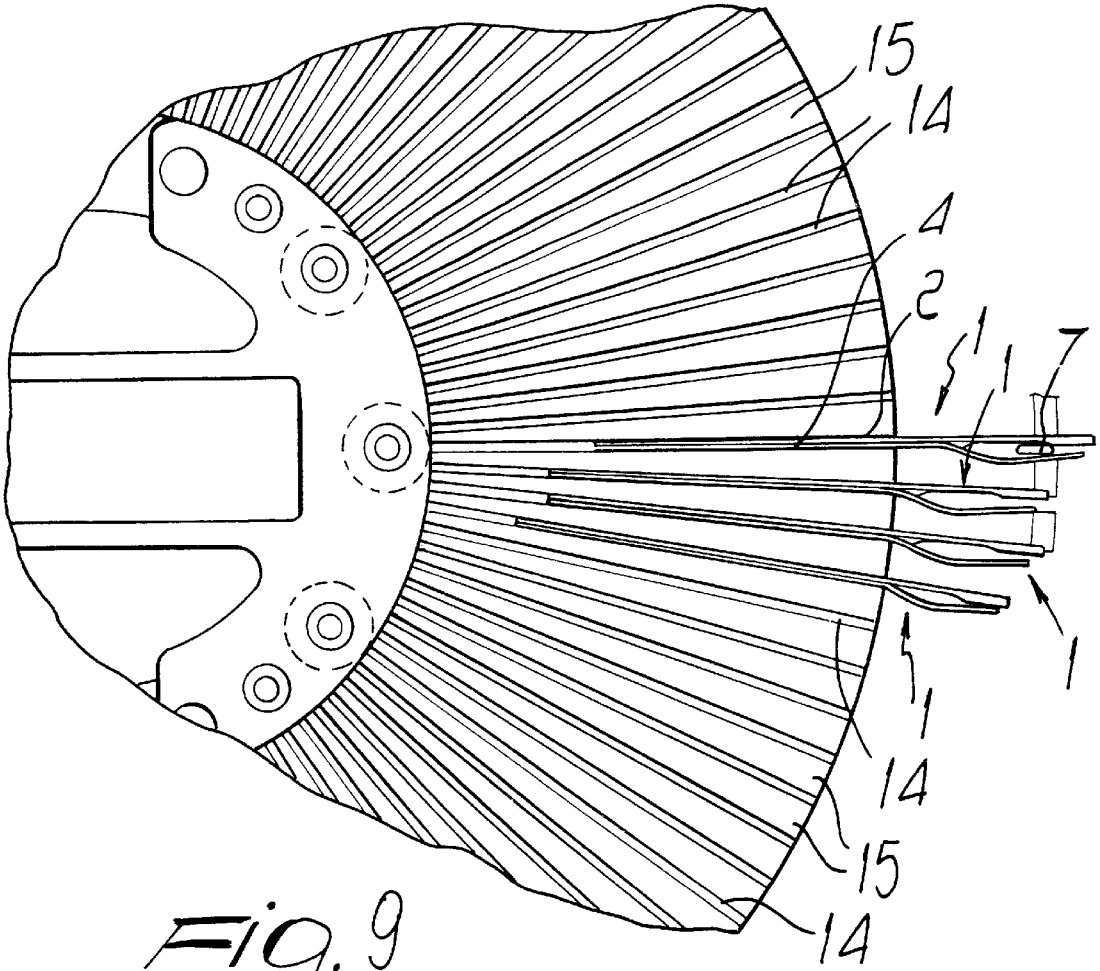
FIG. 9 is a schematic top plan view of an overturning semicircular plate with hooks according to the invention.
Figure 10:
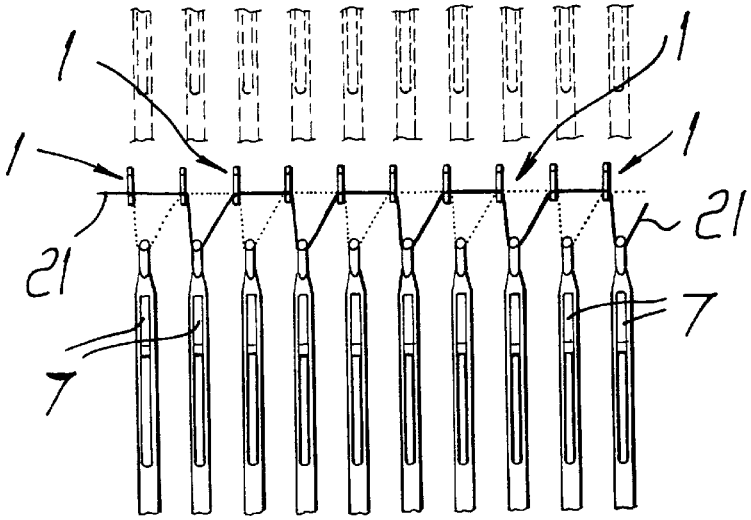
FIG. 10 is a side view of a portion of a circular knitting or stocking machine, projected onto a plane, which illustrates the engagement of the loops of knitting by hooks according to the invention.

When the semicircular plate 15 faces the needles of the other half of the needle cylinder, as shown in FIG. 8, the hook 1 is again pushed radially towards the outside of the groove 14, so as to place the passage 6 at the corresponding needle 7, which is raised until its tip passes through the passage 6. It should be noted that when the hook is extracted from the groove 14 of the semicircular plate 15, in the position illustrated in FIG. 8, the claw-shaped tip 5 of the lamina element 4 is spaced laterally with respect to the hook body 2, facilitating the passage of the tip of the needle 7.

When the needle is in this position, the hook 1 is retracted again into the corresponding groove 14, releasing the loop of knitting onto the stem of the needle 7, which engages it by moving downwards.

It should be noted that the transfer of the loops of knitting can be performed at the beginning of the formation of the tubular item or at the end of its formation, depending on the method used to close the tip.

In practice it has been observed that the hook according to the invention fully achieves the intended aim, since it is capable of retaining and transferring loops from the needles of one half of the needle cylinder to the needles of the other half of the needle cylinder, thus allowing to produce tubular items which are closed at one of their axial ends at the beginning or at the end of their formation on the circular knitting or stocking machine. In practice, the hook according to the invention is capable of performing said transfer without requiring the use of a pair of hooks for each loop of knitting and therefore considerably simplifies the overall structure of the circular or semicircular plate which is used.

The hook thus conceived is susceptible of numerous modifications and variations, all of which are within the scope of the inventive concept; all the details may also be replaced with other technically equivalent elements.

In practice, the materials employed, as well as the dimensions, may be any according to requirements and to the state of the art.

What is claimed is:

1. A hook for a single-cylinder circular knitting or stocking machines with cylinder and circular or semicircular plate, the hook comprising:

a flat body with a longitudinal extension and including a lateral face and a first claw-shaped tip disposed at an end of said flat body;

an elastic-lamina element having a second claw-shaped tip disposed at an end of said lamina element, said lamina element being connected with said lateral face of the flat body such that said second claw-shaped tip faces said first claw-shaped tip of the flat body and such that said second claw-shaped tip of said lamina element is laterally spaced from said first claw-shaped tip of said flat body in a non-elastically deformed inactive condition of said elastic-lamina element and such that a passage is formed between said second claw-shaped tip of said lamina element and said first claw-shaped tip flat body in said non-clastically deformed inactive condition of said elastic-lamina element and such that said passage is crossable by a machine needle being insertable into and extractable from said passage in a direction substantially perpendicular to said longitudinal extension of said flat body when said elastic-lamina element is in said non-elastically deformed inactive condition of said lamina element for depositing a loop thread from the machine needle onto the first claw-shaped tip of said flat body; said second claw-shaped tip of said lamina element being elastically flexible towards said first claw-shaped tip of said flat body for closing said claw-shaped tips together for retaining the loop thread between the claw-shaped tips mutually closed togather.

2. A hook according to claim 1, wherein said lamina element is laterally rigidly fixed with said flat body such that said lamina element and said flat body are adapted for being slidable movable with a reciprocating motion always mutually together in a radial plate groove.

3. A hook according to claim 1, wherein said first claw-shaped tip of said flat body protrudes outwards in a direction of said longitudinal extension of the flat body with respect to said second claw-shaped tip of said lamina element for facilitating the depositing of the loop thread from the machine needle onto the first claw-shaped tip of said flat body.

4. A hook according to claim 1, wherein said flat body has at least one actuation heel, said at least one heel protruding transversely to the longitudinal extension of said flat body.

5. A hook according to claim 4, wherein said flat body has two actuation heels, said actuation heels protruding upwards and respectively downwards from the flat body transversely to the longitudinal extension of said flat body.

6. A hook according to claim 1, wherein said flat body has, on said lateral face directed towards said lamina element, a recess, said recess accommodating a part of said lamina element, said part being spaced with respect to the lamina element claw-shaped tip.

7. A hook according to claim 6, wherein said second claw-shaped tip of the lamina element is connected to a flat portion of the lamina element that is connected to said flat body through an inclined portion, said inclined portion being inclined away from said flat portion so that said second claw-shaped tip of the lamina element and said first claw-shaped tip of said flat body are mutually spaced apart.

8. A hook in combination with a knitting or stocking machine with circular or semicircular plate, the hook comprising:

a flat body with a longitudinal extension and including a lateral face and a first claw-shaped tip disposed at an end of said flat body;

an elastic-lamina element having a second claw-shaped tip disposed at an end of said lamina element, said lamina element being associated with said lateral face of the flat body such that said second claw-shaped tip faces said first claw-shaped tip of the flat body and such that said second claw-shaped tip of said lamina element is laterally spaced from said first claw-shape tip of said flat body in a non-elastically deformed inactive condition of said elastic-lamina element and such that a passage is formed between said second claw-shpaed tip of said lamina element and said first claw-shaped tip of said flat body in said non-elastically deformed inactive condition of said elastic-lamina element and such that said pasages is crossable by a machine needle being insertable into and extractable from said passage in a direction substantialy perpendicular to said longitudinal extension of said flat body when said elastic-lamina element is in said non-elastically deformed inactive condition for depositing a loop thread from the machine needle onto the first claw-shaped tip of said flat body; said second claw-shaped tip of said lamina element being elastically flexible towards said first claw-shaped tip of said flat body for closing said claw-shaped tips togather for retaining the loop thread between the claw-shaped tips mutually closed together;

the machine plate having a hook insertion groove with a groove width adapted to allow said hook to be inserted in and extracted from said groove, said first claw-shaped tip of said flat body and said second claw-shaped tip of said lamina element being mutually spaced apart in said non-elastically deformed inactive condition of said lamina element so as to define a maximum thickness region, said maximum thickness region having a width which is greater than said groove width, thereby approaching of said second claw-shaped tip of said lamina element to said first claw-shaped tip of said flat body for closing said claw-shaped tips together for retaining the loop thread between the claw-shaped tips mutually closed together occurs upon insertion of the hook in said groove, and spacing of the second claw-shaped tip of said lamina element from the first claw-shaped tip of said flat body occurs upon extraction of the hook from the groove.

9. A hook according to claim 1, wherein said flat body has, at said passage, a recessed portion on said lateral face thereof for increasing the size of said passage for facilitating the insertion and extraction of the machine needle in said non-elastically deformed inactive condition of said lamina element.

10. A hook according to claim 1, wherein said flat body has, proximate to the claw-shaped tip thereof, a bend away from said lamina element for increasing the size of said passage for facilitating the insertion and extraction of the machine needle in said non-elastically deformed inactive condition of said lamina element.

11. A hook according to claim 10, comprising, at said flat body, at least a portion of the flat body that lies between said bend and the first claw-shaped tip thereof which is elastically flexible towards and away from the second claw-shaped tip of said lamina element.

* * * * *